US010079477B2

(12) United States Patent
Uchiyama

(10) Patent No.: US 10,079,477 B2
(45) Date of Patent: Sep. 18, 2018

(54) METHOD OF MANUFACTURING SPARK PLUG

(71) Applicant: NGK SPARK PLUG CO., LTD., Nagoya-shi, Aichi (JP)

(72) Inventor: Daishi Uchiyama, Tsushima (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 105 days.

(21) Appl. No.: 15/187,887

(22) Filed: Jun. 21, 2016

(65) Prior Publication Data

US 2016/0380411 A1 Dec. 29, 2016

(30) Foreign Application Priority Data

Jun. 25, 2015 (JP) ..... 2015-127779

(51) Int. Cl.
*H01T 21/02* (2006.01)
*H01T 13/32* (2006.01)

(52) U.S. Cl.
CPC ..... *H01T 21/02* (2013.01); *H01T 13/32* (2013.01)

(58) Field of Classification Search
CPC ..... H01T 21/02
See application file for complete search history.

(56) References Cited

U.S. PATENT DOCUMENTS

2002/0081932 A1* 6/2002 Hanai ..... B23K 11/0046 445/7
2011/0198982 A1 8/2011 Suzuki et al.
2014/0011417 A1 1/2014 Ichihara

FOREIGN PATENT DOCUMENTS

JP 2002-198157 A 7/2002 ..... B23K 11/00
JP 2009-016129 A 1/2009 ..... F02P 13/00
JP 2010-020902 A 1/2010 ..... F02P 13/00
JP 2014-135213 A 7/2014 ..... H01T 13/02
WO WO 2010/053099 5/2010 ..... H01T 13/20

OTHER PUBLICATIONS

Extended European Search Report issued in corresponding European Patent Application No. 16175787.7, dated Sep. 28, 2016.

* cited by examiner

*Primary Examiner* — Nimeshkumar Patel
*Assistant Examiner* — Jacob R Stern
(74) *Attorney, Agent, or Firm* — Kusner & Jaffe

(57) ABSTRACT

A method of manufacturing a spark plug includes a step (a) of chucking, by mutually facing chucks, a metallic shell extending along its center axis so as to fix the metallic shell, and (b) a step of pressing a ground electrode against the fixed metallic shell and applying voltage between the ground electrode and the chucks for resistance-welding the ground electrode and the metallic shell. A first chuck facing a second chuck, wherein, as viewed on an imaginary plane of projection perpendicular to the center axis, the number of support points on the second chuck is smaller than the number of support points on the first chuck for supporting the metallic shell.

16 Claims, 12 Drawing Sheets

METHOD OF MANUFACTURING SPARK PLUG

RELATED APPLICATION

This application claims the benefit of Japanese Patent Application No. 2015-127779, filed Jun. 25, 2015, the entire contents of which are incorporated herein by reference.

FIELD OF THE INVENTION

The present invention relates to a method of manufacturing a spark plug.

BACKGROUND OF THE INVENTION

Conventionally, a ground electrode is attached to an end surface of a metallic shell by the following method: the metallic shell is fixedly held between mutually facing chucks so as to dispose the ground electrode at a predetermined position, after which the ground electrode is welded to the metallic shell. Resistance welding is performed for this welding process (See WO2010/053099). In this process of resistance welding, in order to reduce contact resistance between the chucks and the metallic shell, a substantially circular columnar portion of the metallic shell is held between the chucks whose cavities collectively assume a cylindrical shape having a diameter substantially equal to that of the circular columnar portion of the metallic shell (See Japanese Patent Application Laid-Open (kokai) No. 2009-16129).

According to the above technique, in the theoretical case where the diameter of the collectively cylindrical cavities of the chucks is equal to the outside diameter of the substantially circular columnar portion of the metallic shell or in the case where the difference in diameter between them is to such an extent as to be absorbable through elastic deformations of the metallic shell and the chucks, the collectively cylindrical cavities of the chucks and the substantially circular columnar portion of the metallic shell come into surface contact with each other. However, in other cases, the following states of contact arise. Specifically, in the case where the diameter of the collectively cylindrical cavities of the chucks is smaller than the outside diameter of the substantially circular columnar portion of the metallic shell, the metallic shell fails to be sufficiently received in the cavities of the chucks and comes into contact with only opposite ends of the recess of a chuck. In the case where the diameter of the collectively cylindrical cavities of the chucks is larger than the outside diameter of the substantially circular columnar portion of the metallic shell, the metallic shell comes into contact with the deepest region of the recess of a chuck.

That is, according to the above technique, the contact area between the metallic shell and the chucks may possibly vary greatly depending on the outside diameter of the substantially circular columnar portion of the metallic shell being substantially equal to, greater than, or smaller than the diameter of the collectively cylindrical cavities of the chucks. As a result, current which flows in resistance welding varies greatly due to attachment errors and dimensional errors produced in the course of manufacture of the metallic shell and the chucks. Therefore, the quality of attachment of the ground electrode to the metallic shell becomes unlikely to be secured.

Also, in the case where the attachment positions of the facing chucks are misaligned from each other, the metallic shell and the chucks fail to come into theoretical surface contact with each other; as a result, resistance welding cannot be performed as expected.

SUMMARY OF THE INVENTION

The present invention has been conceived to address the above problem and can be embodied in the following modes or application examples.

(1) In accordance with a first aspect of the present invention, there is provided a method of manufacturing a spark plug. The method of manufacturing a spark plug comprises (a) a step of chucking, by mutually facing chucks, a metallic shell extending along its center axis so as to fix the metallic shell, and (b) a step of pressing a ground electrode against the fixed metallic shell and applying voltage between the ground electrode and the chucks for resistance-welding the ground electrode and the metallic shell. Mutually facing sides of the chucks differ in shape from each other; the chucks are composed of a first chuck and a second chuck; and as viewed on an imaginary plane of projection perpendicular to the center axis, the number of support point(s) on the second chuck for supporting the metallic shell is smaller than the number of support points on the first chuck for supporting the metallic shell.

Through employment of such a mode, the metallic shell is supported by the chucks at a plurality of points located apart from one another rather than at a surface. As a result, the contact area between the metallic shell and the chucks is unlikely to vary, which could otherwise result from attachment errors and dimensional errors produced in the course of manufacture of the metallic shell and the chucks; therefore, current which flows in the course of resistance welding is unlikely to vary greatly. Thus, the quality of attachment of the ground electrode to the metallic shell can be easily maintained at a fixed level. Also, in holding the metallic shell by the chucks, the metallic shell can be more easily varied in position in relation to the second chuck having a relatively smaller number of support points than in relation to the first chuck having relatively a larger number of support points. As a result, in holding the metallic shell by the chucks, the metallic shell is held at a fixed relative position in relation to the first chuck, whereas the metallic shell can be disposed at a position in relation to the second chuck which is corrected for manufacturing errors and attachment errors. In view of this also, the contact area between the metallic shell and the chucks becomes unlikely to vary due to attachment errors and dimensional errors produced in the course of manufacture of the metallic shell and the chucks.

(2) In accordance with second aspect of the present invention, there is provided the method of manufacturing a spark plug of the above mode, wherein, as viewed on the imaginary plane, in the step (a), the metallic shell is supported at two support points by the first chuck and at one support point by the second chuck. Through employment of such a mode, the metallic shell can be stably supported at three points by the first and the second chucks. Also, in holding the metallic shell by the chucks, the metallic shell can be easily moved in position in relation to the second chuck which supports the metallic shell at one point. As a result, the contact area between the metallic shell and the chucks becomes unlikely to vary due to attachment errors and dimensional errors produced in the course of manufacture of the metallic shell and the chucks.

(3) In accordance with a third aspect of the present invention, there is provided the method of manufacturing a spark plug of the above mode, wherein, as viewed on the imaginary plane, the second chuck has a support surface which supports the metallic shell and at least a portion of which is positioned on a straight line which connects a center axis of the metallic shell and a midpoint between the two support points at which the metallic shell is supported by the first chuck. Through employment of such a mode, the metallic shell is positioned by the two support points of the first chuck with respect to a direction in which the two support points are juxtaposed. Additionally, the metallic shell is supported by a portion of the support surface of the second chuck which is positioned on the straight line which connects the center axis of the metallic shell and the midpoint between the two support points. As a result, the metallic shell is supported stably even though the metallic shell is disposed at an arbitrary position by the two support points.

(4) In accordance with a fourth aspect of the present invention, there is provided the method of manufacturing a spark plug of the above mode, wherein, as viewed on the imaginary plane, the first chuck has first and second surfaces which support the metallic shell and which partially constitute a surface of a recess of the first chuck for receiving the metallic shell; and the first surface and the second surface are symmetrical to each other with respect to the straight line, and the support surface is symmetrical with respect to the straight line. Through employment of such a mode, regarding a direction in which the first and the second surfaces face each other, the metallic shell is accurately positioned at the mid position between the first surface and the second surface. Further, even though the metallic shell is disposed at an arbitrary position as a result of support by the first and the second surfaces, the contact area between a third surface and the metallic shell does not change. Also, the first and the second surfaces are highly likely to be uniform in wear.

(5) In accordance with a fifth aspect of the present invention, there is provided the method of manufacturing a spark plug of any one of the above modes, wherein, the first and the second surfaces are planes. Through employment of such a mode, even though the diameter of the metallic shell varies due to manufacturing errors, a great change does not arise in the state of contact between the outer surface of the metallic shell and the first and the second surfaces. As a result, the contact area between the metallic shell and the first and the second surfaces does not vary greatly. Also, the first and the second surfaces and the support surface of the chucks can be rendered closer in wear to one another.

(6) In accordance with a sixth aspect of the present invention, there is provided the method of manufacturing a spark plug of any one of the above modes, wherein, the step (a) includes a step of pressing the metallic shell against the positionally fixed second chuck by use of the first chuck so as to fix the metallic shell. Through employment of such a mode, the metallic shell can be positioned by the second chuck with respect to a direction in which the first and the second chucks face each other.

(7) In accordance with a seventh aspect of the present invention, there is provided the method of manufacturing a spark plug of any one of the above modes, preferably, the step (b) includes a step of pressing the ground electrode against a position located on the metallic shell and on a line segment which connects the center axis of the metallic shell and any one of the support points at which the first and the second chucks support the metallic shell as viewed on the imaginary plane, and resistance-welding the ground electrode to the metallic shell. Through employment of such a mode, there can be reduced a distance between a region where the ground electrode and the metallic shell are in contact with and welded to each other, and a support point at which the metallic shell and a relevant chuck are in contact with each other. As a result, since a current path becomes short and thus becomes unlikely to vary, resistance welding can be performed stably.

(8) In accordance with an eighth aspect of the present invention, there is provided the method of manufacturing a spark plug of any one of the above modes, wherein, as viewed on the imaginary plane, the step (b) includes a step of pressing the ground electrode against a position located on the metallic shell and in a direction directed from the center axis of the metallic shell toward a midpoint between two of the three support points at which the first and the second chucks support the metallic shell, and resistance-welding the ground electrode to the metallic shell. Through employment of such a mode, when, due to manufacturing errors or the like, a region where the ground electrode and the metallic shell are in contact with and welded to each other approaches one of the two support points at which the metallic shell and the chucks are in contact with each other, the region where the ground electrode and the metallic shell are in contact with and welded to each other is distanced from the other support point, and vice versa. As a result, variation in the length of a current path stemming from manufacturing errors becomes small, whereby resistance welding can be performed stably.

(9) In accordance with a ninth aspect of the present invention, there is provided the method of manufacturing a spark plug of any one of the above modes, wherein, the metallic shell has a portion having a substantially circular columnar shape; the chucks have a length equal to or greater than a length of the substantially circular columnar portion of the metallic shell along the center axis of the metallic shell; and in the step (a), the metallic shell is supported along the center axis thereof by the first chuck at the two support points over the entire length of the substantially circular columnar portion and by the second chuck at the one support point over the entire length of the substantially circular columnar portion. Through employment of such a mode, the contact area between the metallic shell and the chucks can be increased to thereby reduce contact resistance between the metallic shell and the chucks, whereby resistance welding can be performed efficiently.

(10) In accordance with a tenth aspect of the present invention, there is provided the method of manufacturing a spark plug of any one of the above modes, wherein, the step (b) includes a step of disposing the ground electrode above the metallic shell and resistance-welding the ground electrode to the metallic shell while supplying an inert gas toward a contact region between the ground electrode and the metallic shell from a horizontal direction or from a lower position. Through employment of such a mode, while oxidation of a weld zone is prevented, the ground electrode and the metallic shell can be resistance-welded to each other. As a result, the ground electrode and the metallic shell can be strongly welded. Also, while interference is avoided between a device disposed above for holding the ground electrode and a device for supplying an inert gas, the inert gas can be supplied to a weld region from near the weld region. Therefore, the inert gas can be concentratedly supplied to the weld region.

(11) In accordance with an eleventh aspect of the present invention, there is provided the method of manufacturing a spark plug of any one of the above modes, wherein, a surface of the metallic shell to which the ground electrode is connected has a width of 1.5 mm or less in a radial direction of the metallic shell. In such a mode, attachment errors and dimensional errors produced in the course of manufacture of the metallic shell and the chucks have a great effect on accuracy in relative position between the metallic shell and the chucks in welding. Also, in the event of deviation of a relative angle between the metallic shell and the ground electrode from an intended value, welding strength is highly likely to deteriorate. Thus, the present invention is particularly effective for such a mode.

(12) In accordance with a twelfth aspect of the present invention, there is provided the method of manufacturing a spark plug of any one of the above modes, wherein, the metallic shell comprises a first portion which has a substantially circular columnar shape having a first diameter and an end to which the ground electrode is resistance-welded, and a second portion which has a substantially circular columnar shape having a second diameter greater than the first diameter; in the step (a), the metallic shell is chucked at the first portion by the first and the second chucks; and in the metallic shell, a distance from an end surface of the second portion located toward the first portion to the end of the first portion to which the ground electrode is resistance-welded is 26.5 mm or more. In such a mode, attachment errors in attachment of the metallic shell to the chucks have a great effect on accuracy in relative position between the metallic shell and the chucks in welding. Thus, the present invention is particularly effective for such a mode.

The present invention can be embodied in various modes other than a method of manufacturing a spark plug. For example, the present invention can be embodied in a spark plug, a metal member manufactured through joining, a welding method for a metal member and a control method for the welding process, a computer program for implementing the control method, a permanent recording medium in which the computer program is recorded, etc.

DETAILED DESCRIPTION OF THE PREFERRED EMBODIMENTS

Figure 1:
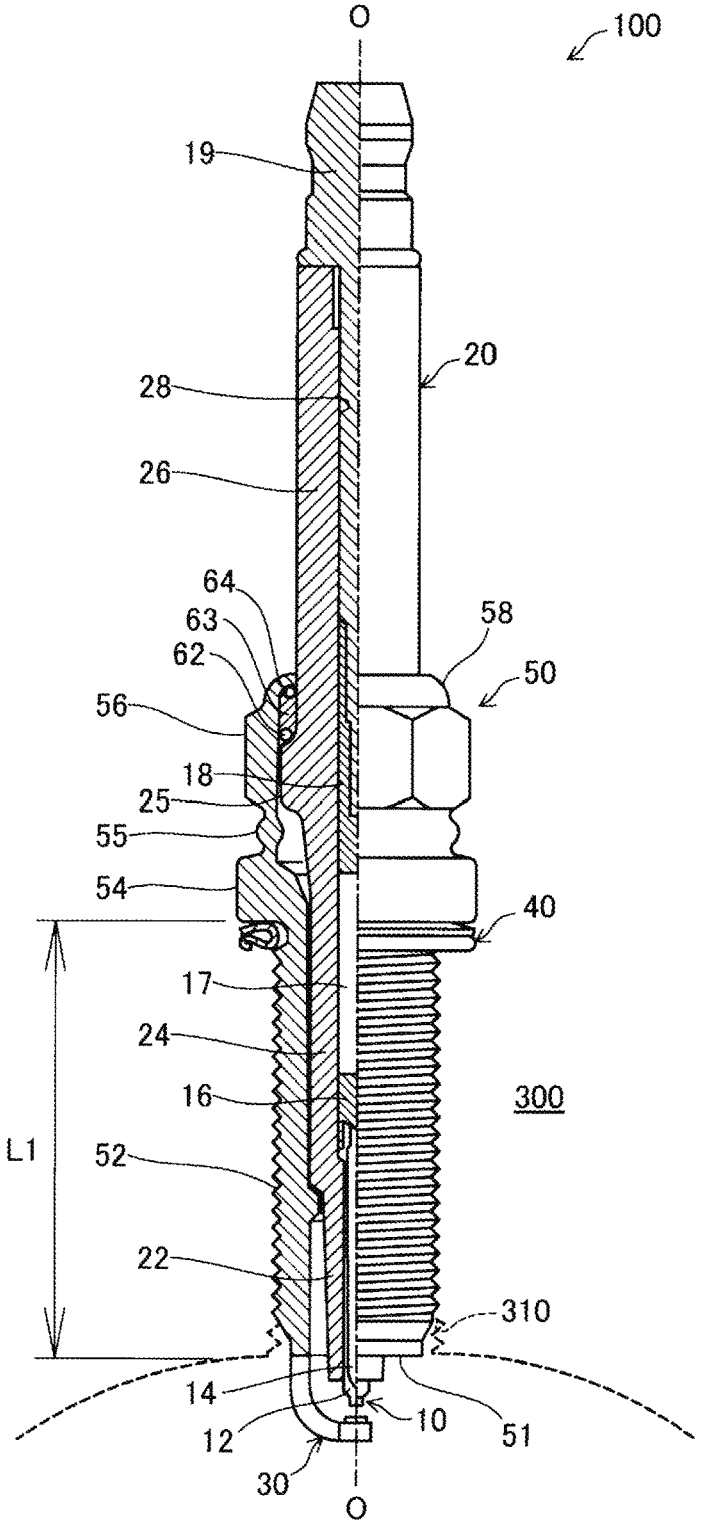
FIG. 1 is a partially sectional view showing a spark plug 100.

A. Embodiment:

A1. Configuration of Spark Plug:

FIG. 1 is a partially sectional view showing a spark plug 100. FIG. 1 shows the external appearance of the spark plug 100 on one side with respect to an axial line O-O which is an axis of the spark plug 100, and the section of the spark plug 100 on the other side. The spark plug 100 includes a center electrode 10, an insulator 20, a metallic shell 50, and a ground electrode 30. In the present embodiment, the axial line O-O of the spark plug 100 also serves as axes of the center electrode 10, the insulator 20, and the metallic shell 50.

In the spark plug 100, the outer circumference of the rod-like center electrode 10 extending along the axial line O-O is electrically insulated by the insulator 20. One end of the center electrode 10 protrudes from one end of the insulator 20. The metallic shell 50 is fixed to the outer circumference of the insulator 20 by hot crimping while being electrically insulated from the center electrode 10. The ground electrode 30 is electrically connected to the metallic shell 50, and a spark gap is formed between the center electrode 10 and the ground electrode 30 for generating sparks therein. The spark plug 100 is attached to an engine head 300 of an internal combustion engine (not shown) such that the metallic shell 50 is threadingly engaged with a mounting threaded hole 310 formed in the engine head 300. Upon application of a high voltage of 20,000 volts to 30,000 volts between the center electrode 10 and the ground electrode 30, sparks are generated in the spark gap formed between the center electrode 10 and the ground electrode 30.

The center electrode 10 of the spark plug 100 is a rod-like electrode formed such that a core metal 14 is embedded in a closed-bottomed tubular electrode base metal 12, the core metal 14 being superior to the electrode base metal 12 in thermal conductivity. In the present embodiment, the center electrode 10 is fixed to the insulator 20 such that a forward end of the electrode base metal 12 protrudes from one end of the insulator 20, and is electrically connected to a metal terminal member 19 through a seal member 16, a ceramic resistor 17, and a seal member 18. In the present embodiment, the electrode base metal 12 of the center electrode 10 is formed of a nickel alloy which contains nickel as a main component, such as INCONEL (registered trademark), and the core metal 14 of the center electrode 10 is formed of copper or an alloy which contains copper as a main component.

The ground electrode 30 of the spark plug 100 is welded to the metallic shell 50 and is bent in such a direction as to intersect with the axial line O-O of the center electrode 10 to thereby face the forward end of the center electrode 10.

In the present embodiment, the ground electrode 30 is formed of a nickel alloy which contains nickel as a main component, such as INCONEL (registered trademark).

The insulator 20 of the spark plug 100 is formed from an insulating ceramic material such as alumina by firing. The insulator 20 is a tubular member having an axial hole 28 for accommodating the center electrode 10 and includes along the axial line O-O a leg portion 22, a first trunk portion 24, a collar portion 25, and a second trunk portion 26 in this order from a protruding side of the center electrode 10. The leg portion 22 of the insulator 20 is a tubular portion whose outside diameter reduces toward the protruding side of the center electrode 10. The first trunk portion 24 of the insulator 20 is a tubular portion greater in outside diameter than the leg portion 22. The collar portion 25 of the insulator 20 is a tubular portion greater in outside diameter than the first trunk portion 24. The second trunk portion 26 of the insulator 20 is a tubular portion smaller in outside diameter than the collar portion 25 and provides a sufficient insulation distance between the metallic shell 50 and the metal terminal member 19.

In the present embodiment, the metallic shell 50 of the spark plug 100 is a nickel-plated member formed of low-carbon steel; however, in other embodiments, the metallic shell 50 may be a zinc-plated member formed of low-carbon steel or a nonplated member formed of a nickel alloy. The metallic shell 50 has a substantially tubular shape extending along the axial line O-O. The metallic shell 50 includes along the axial line O-O an end surface 51, a mounting threaded portion 52, a trunk portion 54, a groove portion 55, a tool engagement portion 56, and a crimp portion 58 in this order from the protruding side of the center electrode 10. The end surface 51 of the metallic shell 50 is an annular surface formed at the forward end of the mounting threaded portion 52; the ground electrode 30 is joined to the end surface 51; and the center electrode 10 inserted into the leg portion 22 of the insulator 20 protrudes from the center of the end surface 51. In the present embodiment, the annular end surface 51 has a width of 1.5 mm in the radial direction of the metallic shell 50 (hereinafter the width may be referred to as the "radial width").

The mounting threaded portion 52 of the metallic shell 50 is a cylindrical portion having an external thread which engages with the mounting threaded hole 310 of the engine head 300. The mounting threaded portion 52 can have a nominal size of, for example, M8, M10, or M12 . The crimp portion 58 of the metallic shell 50 is provided adjacent to the tool engagement portion 56 and is plastically worked so as to come into close contact with the second trunk portion 26 of the insulator 20 in fixing the metallic shell 50 to the insulator 20 by hot crimping. A filler member 63 is formed by filling a region between the crimp portion 58 of the metallic shell 50 and the collar portion 25 of the insulator 20 with talc powder and is sealed by packings 62 and 64.

The groove portion 55 of the metallic shell 50 is formed between the trunk portion 54 and the tool engagement portion 56 through radially inward and outward swelling as a result of compressive deformation in the course of fixing the metallic shell 50 to the insulator 20 by hot crimping. The trunk portion 54 of the metallic shell 50 is a collar-shaped portion provided adjacent to the groove portion 55 and protruding radially outward beyond the groove portion 55 and compresses a gasket 40 toward the engine head 300. The trunk portion 54 is greater in diameter than the mounting threaded portion 52. A dimension L1 along the axial line O-O from the end surface 51 to an end surface of the trunk portion 54 is 26.5 mm. The tool engagement portion 56 of the metallic shell 50 is a collar-shaped portion provided adjacent to the groove portion 55 and protruding radially outward beyond the groove portion 55 and has a polygonal shape for engagement with a tool (not shown) used to attach the spark plug 100 to the engine head 300. In the present embodiment, the tool engagement portion 56 has a hexagonal shape; however, in other embodiments, the tool engagement portion 56 may have other polygonal shapes such as a square shape and an octagonal shape. In the tool engagement portion 56, the distance between opposed sides is 12 mm (millimeters); however, in other embodiments, the distance may be smaller than 12 mm, such as 9 mm, 10 mm, or 11 mm.

Figure 2:
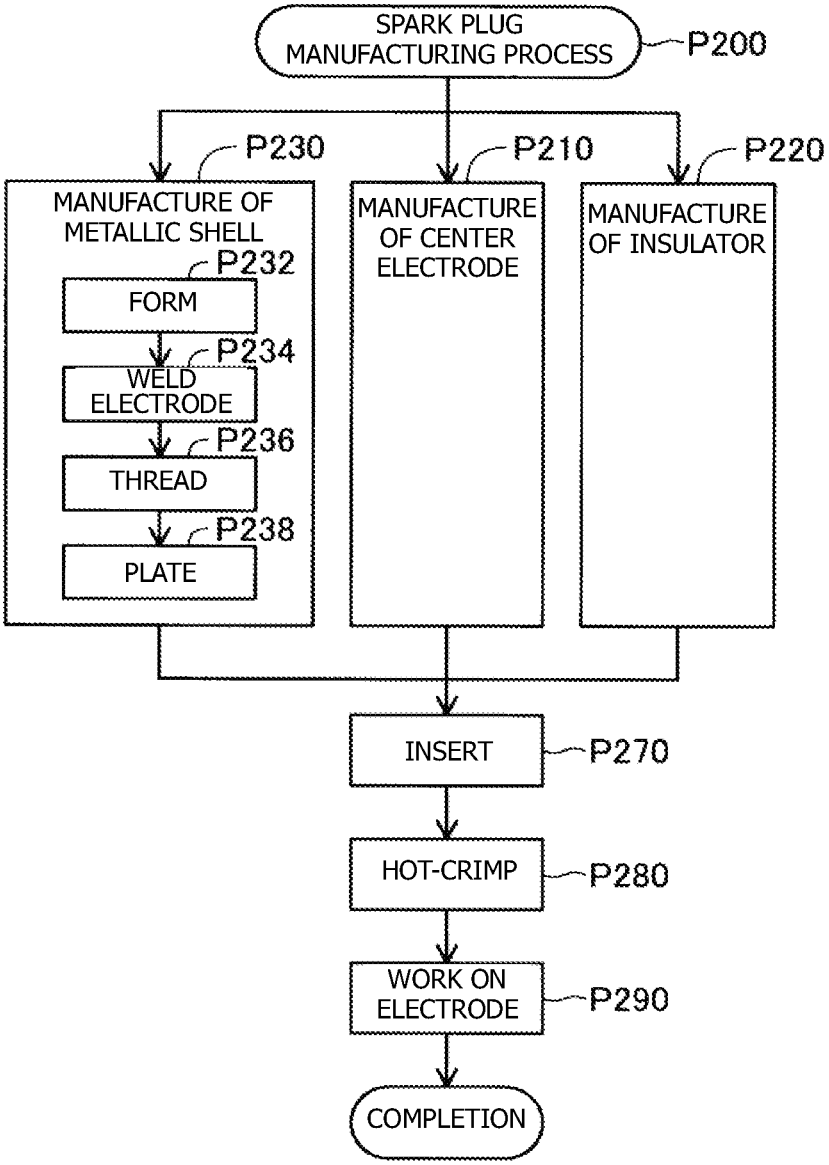
FIG. 2 is a process chart showing a process P200 of manufacturing a spark plug 100.

A2. Method of Manufacturing Spark Plug:

FIG. 2 is a process chart showing a process P200 of manufacturing the spark plug 100. In the process P200 of manufacturing the spark plug 100, first, component members of the spark plug 100, such as the center electrode 10, the insulator 20, and the metallic shell 50, are manufactured (steps P210, P220, and P230).

In the step P230 of manufacturing the metallic shell 50, a cut soft steel material is subjected to pressing and machining to thereby be formed into the shape of the metallic shell 50 (step P232). Subsequently, the unbent rod-like ground electrode 30 is welded to the formed soft steel member (step P234); then, the mounting threaded portion 52 is formed by rolling (step P236). Subsequently, nickel plating and chromate treatment are performed (step P238) to complete the metallic shell 50.

After the component members of the spark plug 100 are manufactured (steps P210, P220, and P230), the insulator 20 assembled with the center electrode 10 is inserted into the metallic shell 50 (step P270).

After insertion of the insulator 20 into the metallic shell 50 (step P270), the metallic shell 50 and the insulator 20 are assembled together by hot crimping.

After hot crimping of the metallic shell 50 (step P280), the ground electrode 30 is bent to form a spark gap between the center electrode 10 and the ground electrode 30 (step P290), thereby completing the spark plug 100.

Figure 3:
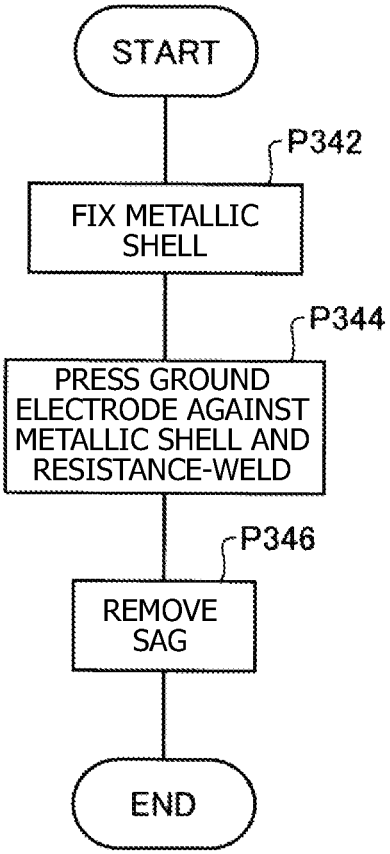
FIG. 3 is a flowchart showing work in welding a ground electrode 30 to a metallic shell 50 in step P234 of FIG. 2.
Figure 4:
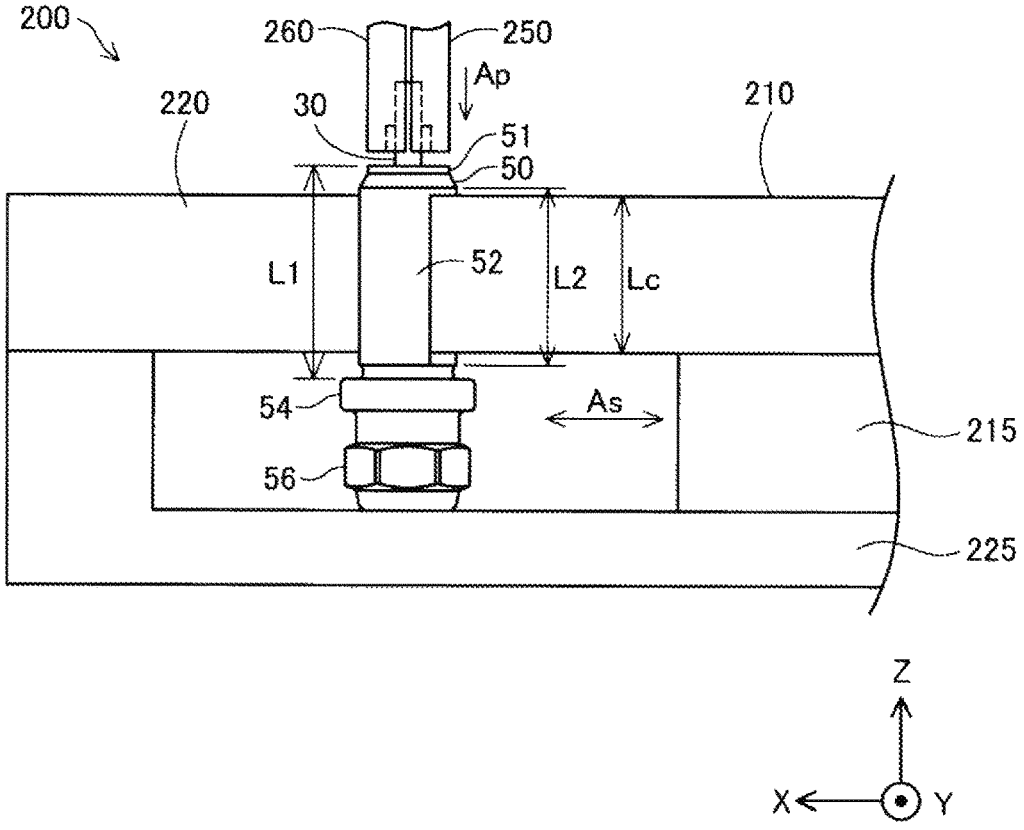
FIG. 4 is an explanatory view showing work in welding the ground electrode 30 to the metallic shell 50 in step P234 of FIG. 2.

A3. Welding of Ground Electrode to Metallic Shell:

FIG. 3 is a flowchart showing work in welding the ground electrode 30 to the metallic shell 50 in step P234 of FIG. 2. FIG. 4 is an explanatory view showing work in welding the ground electrode 30 to the metallic shell 50 in step P234 of FIG. 2. In FIG. 4 and following drawings, in order to facilitate technical understanding, the shape of the metallic shell 50 is simplified and does not strictly coincide with the shape in FIG. 1. In FIG. 4, mutually orthogonal X-, Y-, and Z-axes are shown. When the metallic shell 50 is properly disposed, the axial line O-O of the metallic shell 50 coincides with the Z-axis direction. Some of the subsequent drawings show X-, Y-, and Z-axes which correspond to the X-, Y-, and Z-axes of FIG. 4.

In step P342 of FIG. 3, the metallic shell 50 is chucked and held at a substantially circular columnar portion which is to become the mounting threaded portion 52, between mutually facing chucks 210 and 220 provided in a welding apparatus 200 (see FIG. 4). Notably, herein, in order to facilitate technical understanding, a substantially circular columnar portion which is to be threaded by rolling in step P236 (see FIG. 2) is also called "mounting threaded portion 52."

The chuck 210 is supported by a support member 215. The chuck 220 is supported by a support member 225. In the welding apparatus 200, the support member 225 has a mechanism for adjusting the position of the chuck 220 in the X-axis direction. In the welding apparatus 200, the support member 215, together with the chuck 210, is slidable in a direction indicated by arrow As in relation to the support member 225 and the chuck 220.

Figure 5:
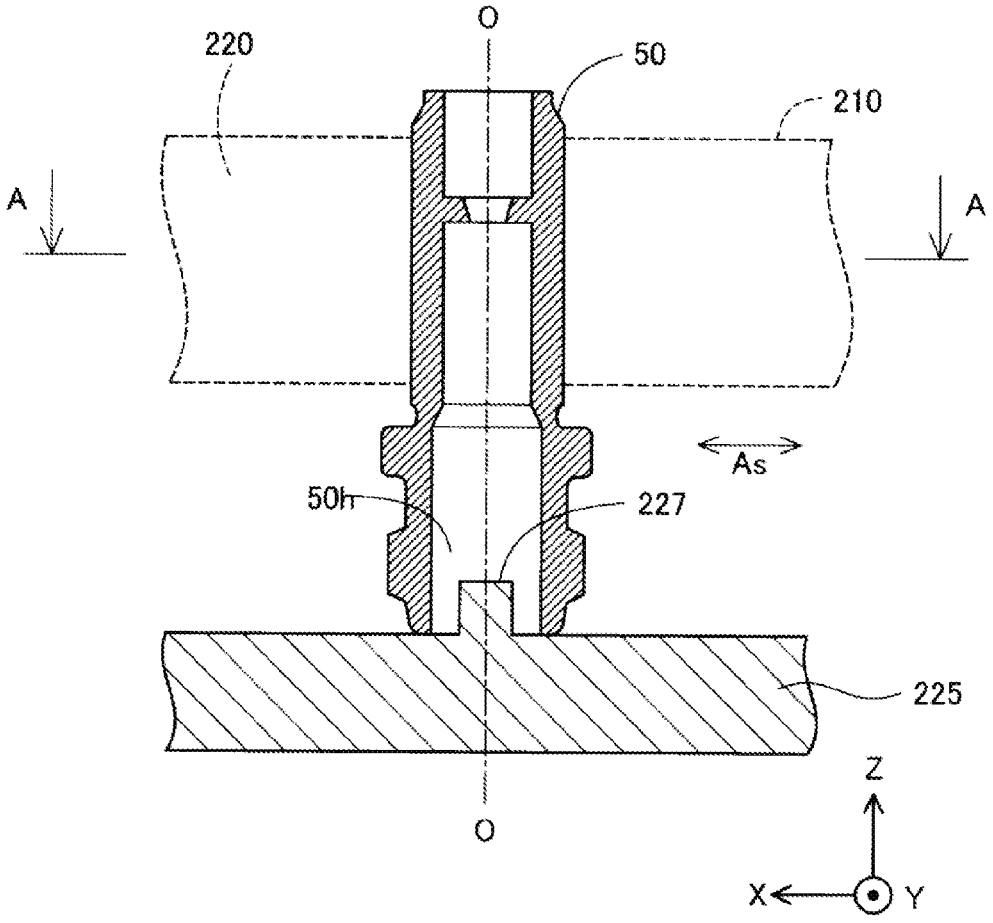
FIG. 5 is a sectional view showing work in holding the metallic shell 50 in step P342 of FIG. 3.

FIG. 5 is a sectional view showing work in holding the metallic shell 50. In step P342 of FIG. 3, in a state in which the chucks 210 and 220 are disposed with a sufficient spacing therebetween in the X-axis direction, the metallic shell 50 is disposed on the support member 225. Specifically, the metallic shell 50 is disposed on an upper surface of the support member 225 in such a manner as to receive, in a hole 50*h*, a circular columnar protrusion 227 provided on the upper surface of the support member 225. Since the hole 50*h* is sufficiently large as compared with the protrusion 227, the metallic shell 50 can move horizontally (X-axis direction and Y-axis direction) on the upper surface of the support member 225.

In this state, the chuck 210 is slid so as to approach the chuck 220. As a result, the metallic shell 50 is chucked and held, on the support member 225, between the chuck 210 and the chuck 220. The chuck 220 is positioned beforehand at a predetermined position in the welding apparatus 200 through the support member 225. Accordingly, in step P342, the metallic shell 50 chucked and held between the chuck 210 and the chuck 220 is accurately positioned in the welding apparatus 200 with respect to the direction As (X-axis direction) along which the chuck 210 slides.

Figure 6:
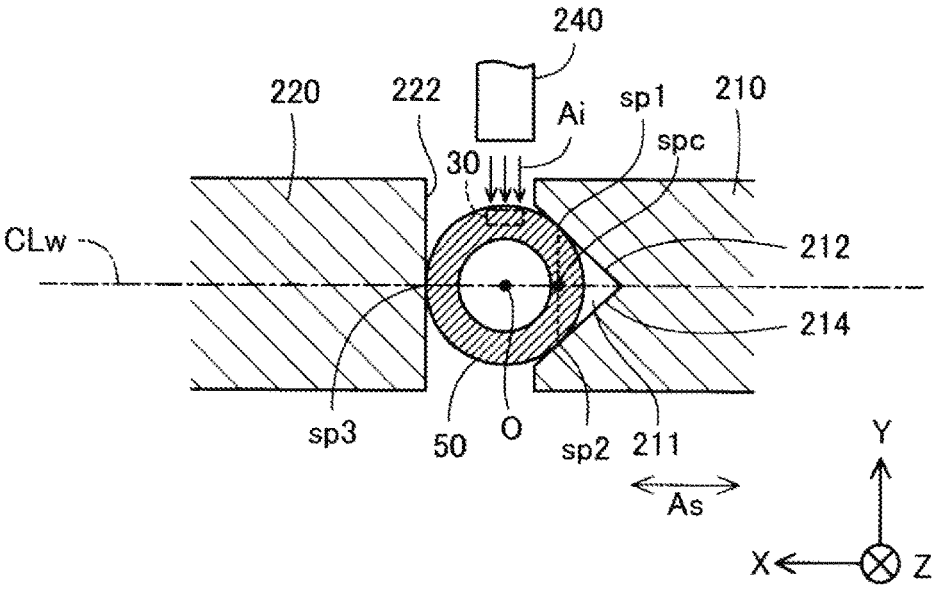
FIG. 6 is a sectional view showing work in holding the metallic shell 50 in step P342 of FIG. 3.

FIG. 6 is a sectional view showing work in holding the metallic shell 50 in step P342 of FIG. 3. FIG. 6 shows a section taken along line A-A of FIG. 5. Next, the shapes of the chucks 210 and 220 in the A-A section will be described. The chuck 220 has a support surface 222 formed at a side which faces the chuck 210 (at the negative side in the X-axis direction). The support surface 222 is a plane perpendicular to a straight line CLw which extends in the As direction along which the chuck 210 slides in relation to the chuck 220. On a horizontal plane (XY plane) onto which the chucks 210 and 220 are projected and on which the projected shapes of the chucks 210 and 220 are symmetrical with respect to an axis, the straight line CLw is the axis of symmetry. When the metallic shell 50 is properly disposed, the axial line O-O of the metallic shell 50 exists on the straight line CLw. The straight line CLw passes through the support surface 222.

The chuck 210 has a recess 211 formed at a side which faces the chuck 220 (at the positive side in the X-axis direction) and adapted to receive the metallic shell 50. The recess 211 is defined by a first surface 212 and a second surface 214 which are planes extending in the vertical direction (Z-axis direction). The first surface 212 and the second surface 214 are planes which face each other while forming an angle of 90 degrees. The first surface 212 and the second surface 214 are symmetrical to each other with respect to a plane which extends vertically (in the Z-axis direction) and contains the straight line CLw extending in a direction in which the chuck 210 slides in relation to the chuck 220, and the support surface 222 has a symmetrical shape with respect to the plane. Thus, in the A-A section shown in FIG. 6, the first surface 212 and the second surface 214 are disposed symmetrical to each other with respect to the straight line CLw, and the support surface 222 has a symmetrical shape with respect to the straight line CLw. In FIG. 6, the ground electrode 30 and a gas nozzle 240 are illustrated; and the ground electrode 30 and the gas nozzle 240 will be referred to in the later description of step P344 (see FIG. 3).

Since the chuck 210 and the chuck 220 have the above-mentioned shapes and structures, in step P342 of FIG. 3, the metallic shell 50 is supported by the chuck 210 at two points sp1 and sp2 in the horizontal plane and by the chuck 220 at one point sp3 in the horizontal plane (see FIG. 6). When the metallic shell 50 is properly held by the chucks, a straight line which connects the axial line O of the metallic shell 50 and a midpoint spc between the support points sp1 and sp2 of the chuck 210 in the horizontal plane coincides with the straight line CLw.

In the present embodiment, a substantially circular columnar portion of the metallic shell 50 is supported by three planes; specifically, the first surface 212, the second surface 214, and the support surface 222 which mutually form an angle of less than 180 degrees. As a result, the metallic shell 50 is supported at the three points sp1, sp2, and sp3 at all times. Thus, even though the metallic shell 50 and the chucks 210 and 220 have dimensional errors, and the chucks 210 and 220 have attachment errors, the state of contact between the metallic shell 50 and the chucks 210 and 220; for example, the contact angle between contact portions, is unlikely to change; as a result, a contact area does not vary greatly. Therefore, a change in contact resistance between the metallic shell 50 and the chucks 210 and 220 can be controlled to fall within a fixed range. Accordingly, the quality of the ground electrode 30 being resistance-welded to the metallic shell 50 can be maintained at a fixed level. Also, the chucks 210 and 220 can be rendered close in wear at a contact point. Therefore, the chucks 210 and 220 can be rendered close in cycle of replacement stemming from wear.

Also, in the present embodiment, the number of points (sp3) of support by the chuck 220 is smaller than the number of points (sp1 and sp2) of support by the chuck 210. As a result, even though the metallic shell 50 and the chucks 210 and 220 have some dimensional errors, and the chucks 210 and 220 have some disposition errors, by means of the metallic shell 50 moving in relation to the chuck which has relatively fewer support points and thus has a relatively higher degree of freedom for disposition of the metallic shell 50, the metallic shell 50 can be properly held by the chucks 210 and 220.

Further, in the present embodiment, the position in the Y-axis direction of a substantially circular columnar portion of the metallic shell 50 is determined by the first surface 212 and the second surface 214 of the chuck 210 which are disposed symmetrical to each other in such a manner as to face each other at an angle of less than 180 degrees. The position in the X-axis direction of the metallic shell 50 is determined by the support surface 222 of the chuck 220. The support surface 222 of the chuck 220 is a plane perpendicular to the X-axis direction. As a result, even though the metallic shell 50 is disposed at an arbitrary position in the Y-axis direction by the first surface 212 and the second surface 214 of the chuck 210, the support surface 222 of the chuck 220 can support the metallic shell 50 in the X-axis direction from the negative side in the X-axis direction. Thus, the metallic shell 50 moves freely in the Y-axis direction perpendicular to the straight line CLw to thereby be properly held by the chucks 210 and 220. Even though the disposition of the metallic shell 50 varies, the contact area between the metallic shell 50 and the chucks is unlikely to vary.

In step P344 of FIG. 3, the rod-like ground electrode 30 is chucked and held between holders 250 and 260 of the welding apparatus 200 (see FIG. 4). As indicated by arrow Ap in FIG. 4, the holders 250 and 260 press the ground electrode 30 against the end surface 51 of the metallic shell 50 from above. While the welding apparatus 200 applies pressing force to the ground electrode 30 and the metallic shell 50, voltage is applied between the holders 250 and 260 and the chucks 210 and 220, thereby resistance-welding the ground electrode 30 to the metallic shell 50.

Figure 7:
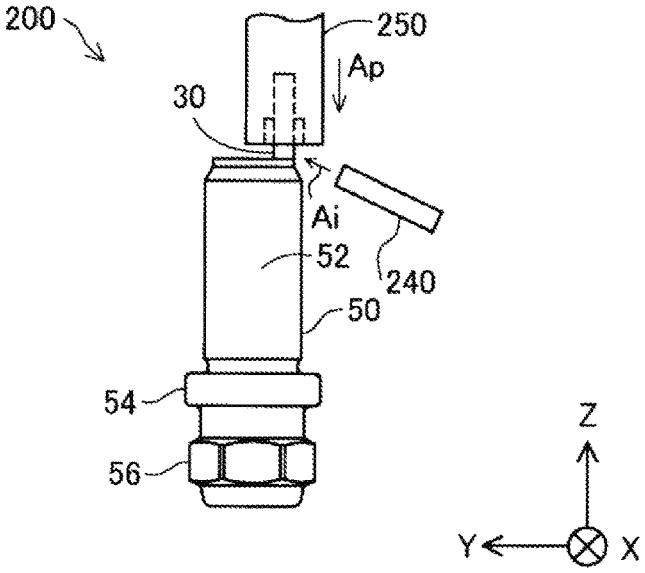
FIG. 7 is an explanatory view showing the emission of inert gas in step P344.

FIG. 7 is an explanatory view showing the emission of inert gas in step P344. In step P344 of FIG. 3, inert gas is emitted (see arrow Ai) toward a weld joint region between the end surface 51 of the metallic shell 50 and an end portion of the ground electrode 30 (see arrow Ai). In the present embodiment, inert gas is nitrogen gas. As shown in FIG. 6, inert gas is emitted toward the weld joint region between the metallic shell 50 and the ground electrode 30 through a space between the chuck 210 and the chuck 220. Such emission of inert gas reduces the degree of oxidation of metal resulting from generation of heat in a weld zone between the ground electrode 30 and the end surface 51 of the metallic shell 50 in welding.

As shown in FIG. 7, the gas nozzle 240 emits inert gas toward the weld joint region between the end surface 51 of the metallic shell 50 and the end portion of the ground electrode 30 from a lower position. Through employment of such emission from a lower position, while interference is avoided between the holders 250 and 260 and gas supply devices including the gas nozzle 240, inert gas can be emitted from the gas nozzle 240 disposed near the weld joint region. As a result, the weld joint region and its periphery can be efficiently insulated from oxygen contained in the atmosphere. In FIG. 7, in order to facilitate technical understanding, illustration of the gas supply device including an inert gas supply line connected to the gas nozzle 240 is omitted.

In resistance welding, a portion of an end portion of the ground electrode 30 pressed against the end surface 51 of the metallic shell 50 is melted and protrudes radially outward (far side of paper in FIG. 4 and right side in FIG. 7). Such a protrusion is called "sag."

In step P346 of FIG. 3, grinding is performed for removing "sag." In step P234 of FIG. 2, the above-mentioned work is performed for welding the ground electrode.

According to the method of manufacturing a spark plug of the present embodiment described above, the metallic shell and the ground electrode can be welded together such that quality variations stemming from dimensional errors and disposition errors of the metallic shell and the chucks are unlikely to arise.

Step P342 in the present embodiment corresponds to "step (a)" appearing in SUMMARY OF THE INVENTION. Step P344 corresponds to "step (b)." The axial line O-O (the axial line O in sectional views) corresponds to "center axis." The chuck 210 corresponds to "first chuck." The chuck 220 corresponds to "second chuck." The midpoint spc corresponds to "midpoint." The straight line CLw corresponds to "straight line." The first surface 212 corresponds to "first surface." The second surface 214 corresponds to "second surface." The mounting threaded portion 52 corresponds to "first portion." The trunk portion 54 corresponds to "second portion."

B. Modes for Shape of Horizontal Section of Chuck:

In the above embodiment, the support surface 222 of the chuck 220 is a plane perpendicular to the X-axis direction (see FIG. 6). The first surface 212 and the second surface 214 of the chuck 210 are planes which are disposed symmetrical to each other with respect to a vertical plane which contains the straight line CLw. However, a portion of a chuck which supports the metallic shell is not limited in shape thereto. For example, the following modes may be employed for the shape of that portion of a chuck which supports the metallic shell. Structural features which are not mentioned in the following description of the modes are similar to those of the embodiment.

In the following description, component members corresponding to those of the above embodiment are denoted by reference numerals assigned to those of the above embodiment with alphabetic suffixes added. The support points at which the chucks support the metallic shell 50 are denoted by reference numerals similar to those of the above embodiment; i.e., sp1 to sp3.

Figure 8:
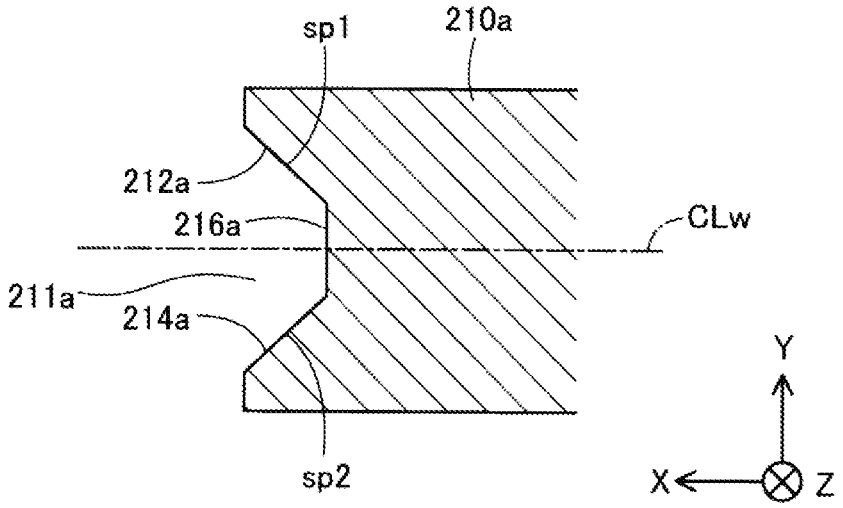
FIG. 8 is a view showing the shape of a horizontal section of a chuck 210*a* of Mode 1.

B1. Mode 1:

FIG. 8 shows the shape of a horizontal section of a chuck 210*a* of Mode 1. Sections perpendicular to the Z-axis appearing in FIG. 8 and subsequent drawings correspond to a section taken along line A-A of FIG. 5.

As shown FIG. 8, the chuck 210*a* has a recess 211*a* formed at a side which faces the chuck 220 (at the positive side in the X-axis direction) and adapted to receive the metallic shell 50. The recess 211*a* is defined by a first surface 212*a*, a second surface 214*a*, and a third surface 216*a* which are planes extending in the vertical direction (Z-axis direction). The third surface 216*a* is a plane perpendicular to the X-axis direction. The first surface 212*a* and the second surface 214*a* are disposed on the positive side and on the negative side in the Y-axis direction, respectively, with respect to the third surface 216*a*. The first surface 212*a* and the second surface 214*a* form an angle of 90 degrees. The first surface 212*a* and the second surface 214*a* are symmetrical to each other with respect to a plane which contains the straight line CLw and extends vertically (Z-axis direction), and the third surface 216*a* has a symmetrical shape with respect to the plane.

Figure 9:
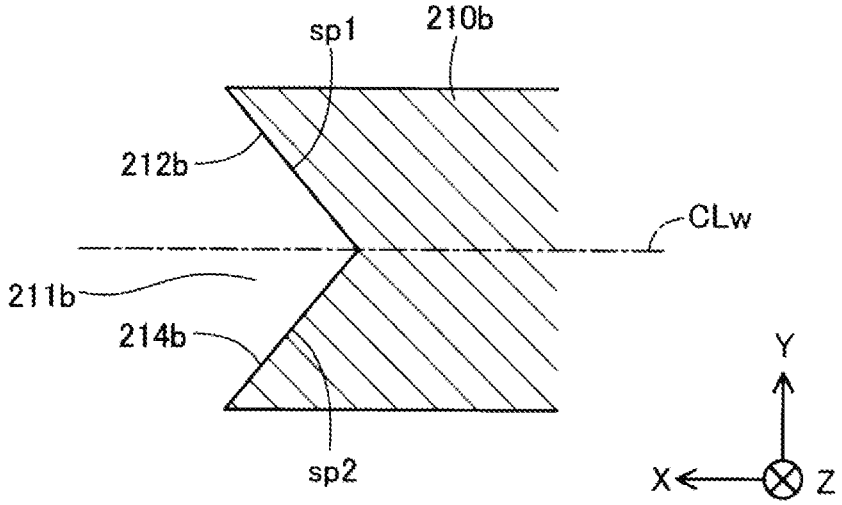
FIG. 9 is a view showing the shape of a horizontal section of a chuck 210of Mode 2.

B2. Mode 2:

FIG. 9 shows the shape of a horizontal section of a chuck 210*b* of Mode 2. The chuck 210*b* has a recess 211*b* formed at a side which faces the chuck 220 (at the positive side in the X-axis direction) and adapted to receive the metallic shell 50. The recess 211*b* is defined by a first surface 212*b* and a second surface 214*b* which are planes extending in the vertical direction (Z-axis direction). A surface of the chuck 210*b* which faces the chuck 220 is composed of the first surface 212*b* and the second surface 214*b*. The first surface 212*b* and the second surface 214*b* form an angle of 90 degrees. The first surface 212*b* and the second surface 214*b* are symmetrical to each other with respect to a plane which contains the straight line CLw and extends vertically (Z-axis direction).

Figure 10:
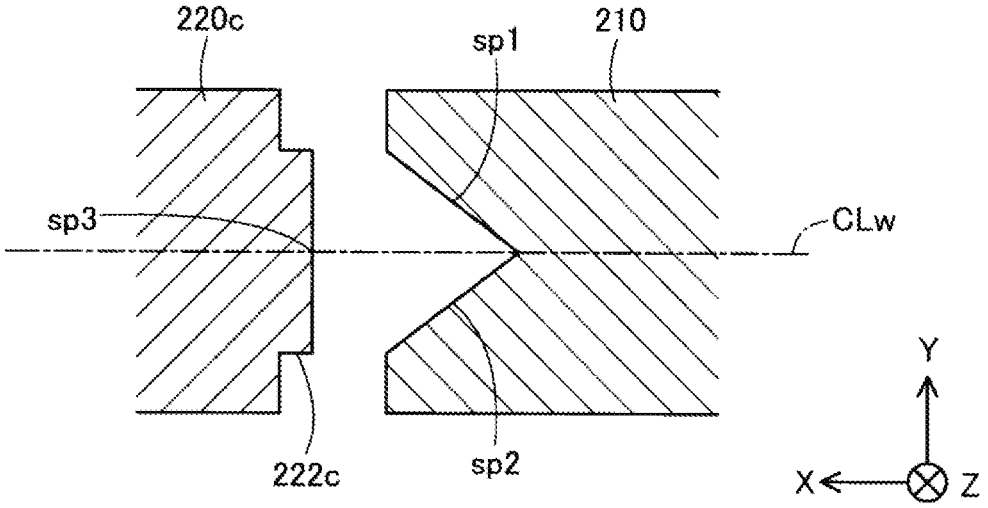
FIG. 10 is a view showing the shape of a horizontal section of a chuck 220*c* of Mode 3.

B3. Mode 3:

FIG. 10 shows the shape of a horizontal section of a chuck 220*c* of Mode 3. The chuck 220*c* has a protrusion 211*c* formed at a side which faces the chuck 210 (at the negative side in the X-axis direction) and adapted to support the metallic shell 50. A surface of the protrusion 211*c* at the negative side in the X-axis direction is a plane perpendicular to the X-axis. When the metallic shell 50 is properly held by the chucks 220*c* and 210, the straight line CLw which passes through the axial line of the metallic shell 50 passes through the plane. The protrusion 211*c* has a symmetrical shape with respect to a plane which contains the straight line CLw and extends vertically (Z-axis direction).

Figure 11:
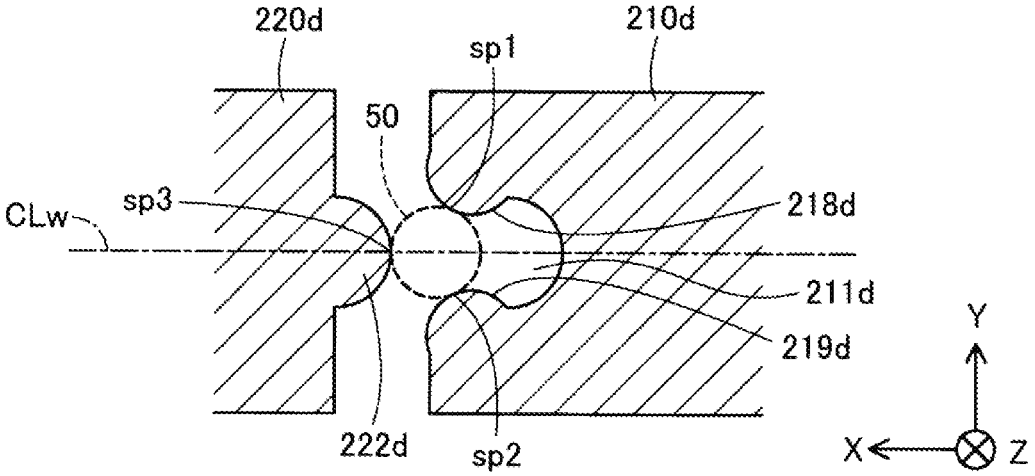
FIG. 11 is a view showing the shapes of horizontal sections of chucks 210*d* and 220*d* of Mode 4.

B4. Mode 4:

FIG. 11 shows the shapes of horizontal sections of chucks 210*d* and 220*d* of Mode 4. The chuck 210*d* has a recess 211*d* formed at a side which faces the chuck 220 (at the positive side in the X-axis direction) and adapted to receive the metallic shell 50. The chuck 210*d* has protrusions 218*d* and

219*d* which are located at the positive side in the Y-axis direction and the negative side in the Y-axis direction, respectively, of the recess 211*d* and which have convexly curved outlines. The protrusions 218*d* and 219*d* are symmetrical to each other with respect to a plane which contains the straight line CLw and extends vertically (Z-axis direction).

The chuck 220*d* has a protrusion 222*d* formed at a side which faces the chuck 210*d* (at the negative side in the X-axis direction) and adapted to support the metallic shell 50. The protrusion 222*d* has a convexly curved outline. When the metallic shell 50 is properly held by the chucks 220*d* and 210*d*, the straight line CLw passes through the protrusion 222*d*. The protrusion 222*d* has a symmetrical shape with respect to a plane which contains the straight line CLw and extends vertically (Z-axis direction).

In Mode 4, the metallic shell 50 is supported at the following three points: a point sp1 on the protrusion 218*d*, a point sp2 on the protrusion 219*d*, and a point sp3 on the protrusion 222*d*.

Figure 12:
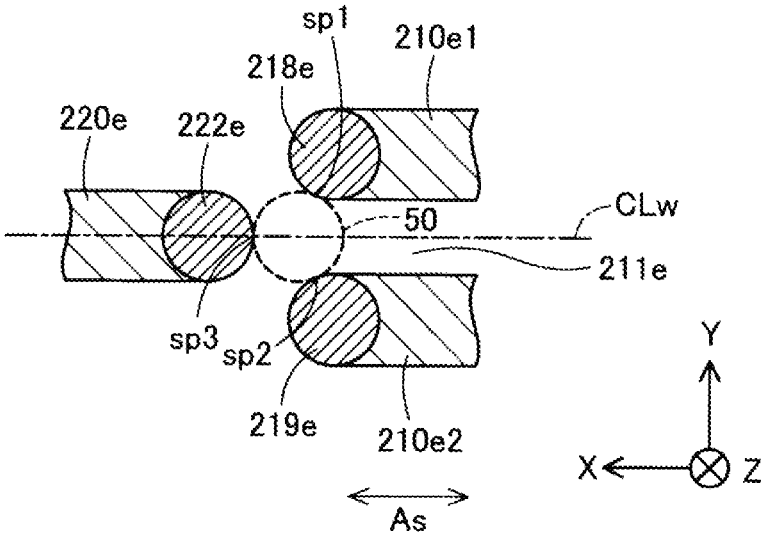
FIG. 12 is a view showing the shapes of horizontal sections of chucks 210*e*1, 210*e*2, and 220*e* of Mode 5.

B5. Mode 5:

FIG. 12 shows the shapes of horizontal sections of chucks 210*e*1, 210*e*2, and 220*e* of Mode 5. In Mode 5, the metallic shell 50 is held by three chucks. The chucks 210*e*1 and 210*e*2 correspond to the chuck 210 of the embodiment and can slide in the X-axis direction in relation to the chuck 220*e*.

The chuck 210*e*1 has a protrusion 218*e* formed at a side which faces the chuck 220*e* (at the positive side in the X-axis direction), and having a curved outline. The chuck 210*e*2 has a protrusion 219*e* formed at the side which faces the chuck 220*e* (at the positive side in the X-axis direction), and having a curved outline. The chucks 210*e*1 and 210*e*2 are juxtaposed in the Y-axis direction with a gap 211*e* formed therebetween for receiving the metallic shell 50. The chucks 210*e*1 and 210*e*2 are symmetrical to each other with respect to a plane which contains the straight line CLw and extends vertically (Z-axis direction).

The chuck 220*e* has a protrusion 222*e* formed at a side which faces the chucks 210*e*1 and 210*e*2 (at the negative side in the X-axis direction), and having a curved outline. When the metallic shell 50 is properly held by the chucks 210*e*1, 210*e*2, and 220*e*, the straight line CLw passes through the protrusion 222*e*. The protrusion 222*e* has a symmetrical shape with respect to a plane which contains the straight line CLw and extends vertically (Z-axis direction).

In Mode 5, the metallic shell 50 is supported at the following three points: a point sp1 on the protrusion 218*e* of the chuck 210*e*1, a point sp2 on the protrusion 219*e* of the chuck 210*e*2, and a point sp3 on the protrusion 222*e* of the chuck 220*e*.

Figure 13:
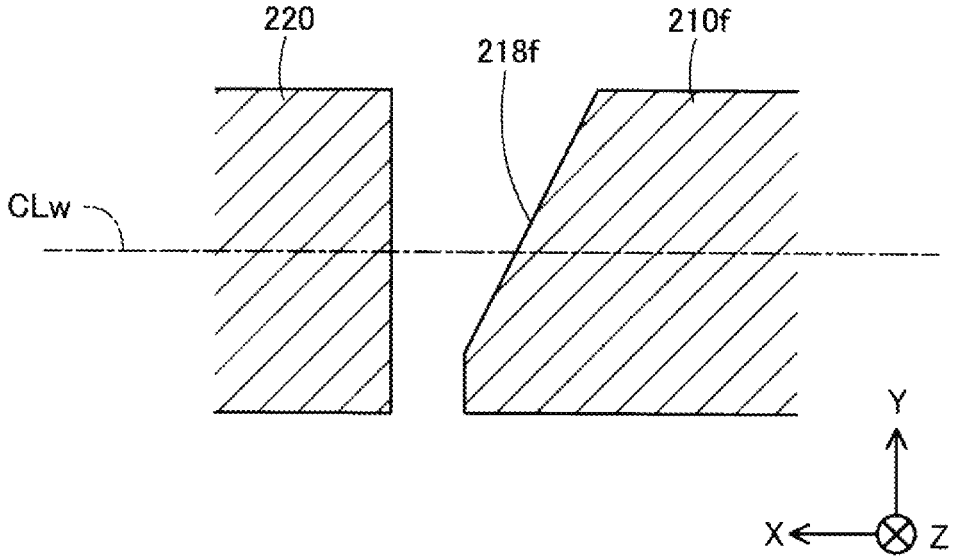
FIG. 13 is a view showing the shape of a horizontal section of a chuck 210*f* of Mode 6.

B6. Mode 6:

FIG. 13 shows the shape of a horizontal section of a chuck 210*f* of the mode 6. The chuck 210*f* has a plane 218*f* formed at a side which faces the chuck 220 (at the positive side in the X-axis direction). The plane 218*f* extends vertically (Z-axis direction) and has a predetermined angle to the X-axis direction. In such a mode, the metallic shell 50 is held at two positions by means of elastic deformations of the metallic shell 50, the chuck 210*f*, and the chuck 220 and by means of frictional force between the metallic shell 50 and the chucks 210*f* and 220. In this mode, preferably, the plane 218*f* of the chuck 210*f* is formed of a material which is more likely to undergo elastic deformation as compared with the chuck 210, etc., of other modes.

A mode for supporting the metallic shell 50 is not limited to a mode in which the metallic shell 50 is supported at the following three points: two support points sp1 and sp2 on the chuck 210 and one support point sp3 on the chuck 220 (See FIG. 6). The metallic shell can be supported at one or more points on each chuck. However, preferably, the number of support points on one chuck is smaller than the number of support points on the other chuck.

Figure 14:
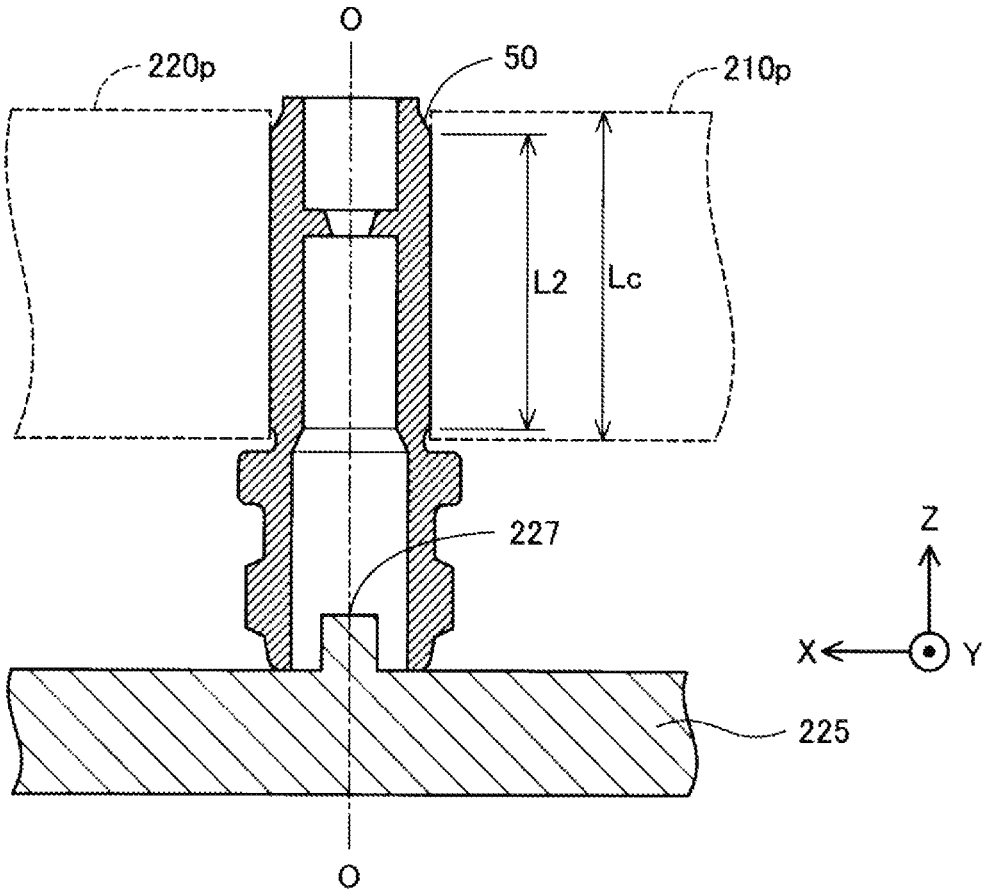
FIG. 14 is a sectional view showing a mode in which the thickness of chucks differs from that of an embodiment.

C. Modes for Shape of Vertical Section of Chuck:

C1. Thickness of Chuck:

FIG. 14 is a sectional view showing a mode in which the thickness of the chucks differs from that of the embodiment. In the above embodiment, as shown in FIG. 4, a thickness Lc in the Z-axis direction of the chucks 210 and 220 is smaller than a thickness L2 of a circular columnar portion (which is to become the mounting threaded portion 52) of the metallic shell 50. However, as in the present mode shown in FIG. 14, the thickness Lc in the Z-axis direction of chucks 210*p* and 220*p* can be greater than the thickness L2 of a circular columnar portion (which is to become the mounting threaded portion 52) of the metallic shell 50. Other structural features of the present mode is similar to those of the embodiment.

In such a mode, the metallic shell 50 can be held by the chuck over the entire length in the Z-axis direction of the circular columnar portion thereof (see FIGS. 6 and 14). As a result, the metallic shell 50 can be stably held.

C2. Shape of Chuck along Thickness Direction:

In the above embodiment, the chucks 210 and 220 are uniform in shape along the Z-axis direction (see FIG. 4). However, the chucks can be nonuniform in shape along the Z-axis direction.

Figure 15:
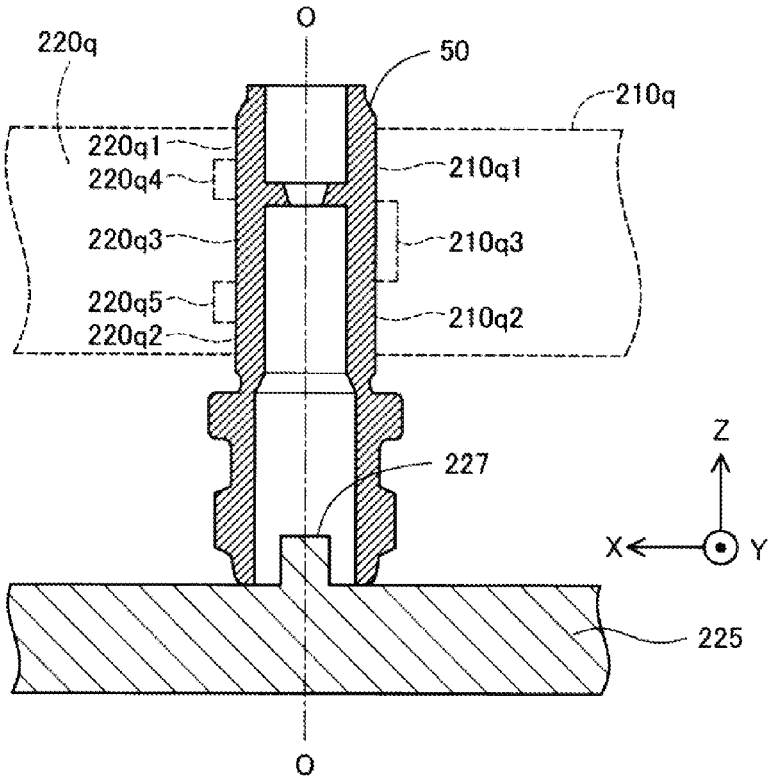
FIG. 15 is a sectional view showing a mode in which the shape along the thickness direction (Z-axis direction) of the chucks differs from that of the embodiment.

FIG. 15 is a sectional view showing a mode in which the shapes along the thickness direction (Z-axis direction) of the chucks differ from those of the embodiment. On the side facing a chuck 220*q*, a chuck 210*q* has portions 210*q*1 and 210*q*2 which relatively protrude in the positive direction of the X-axis, and a portion 210*q*3 which is recessed in the negative direction of the X-axis in relation to the portions 210*q*1 and 210*q*2.

A chuck 220*q* has, at a side which faces the chuck 210*q*, portions 220*q*1, 220*q*2, and 220*q*3 which relatively protrude in the negative direction of the X-axis, and portions 220*q*4 and 220*q*5 which are recessed in the positive direction of the X-axis in relation to the portions 220*q*1, 220*q*2, and 220*q*3. Other structural features of the present mode is similar to those of the embodiment.

In such a mode, the metallic shell 50 is held by the relatively protruding portions 210*q*1 and 210*q*2 of the chuck 210*q* and the relatively protruding portions 220*q*1, 220*q*2, and 220*q*3 of the chuck 220*q*. As a result, as compared with a mode in which the metallic shell 50 is held by the ends of the chucks over the entire length in the Z-axis direction, the metallic shell 50 can be pressed and held under a strong pressure.

D. Modes for Disposition of Ground Electrode:

In the above embodiment, the ground electrode 30 is disposed on the end surface 51 of the metallic shell 50 at a position located on the positive side in the Y-axis direction with respect to the axial line O (see FIG. 6). However, the disposition of the ground electrode 30 on the end surface 51 of the metallic shell 50 can differ from the above disposition as described below.

Figure 16:
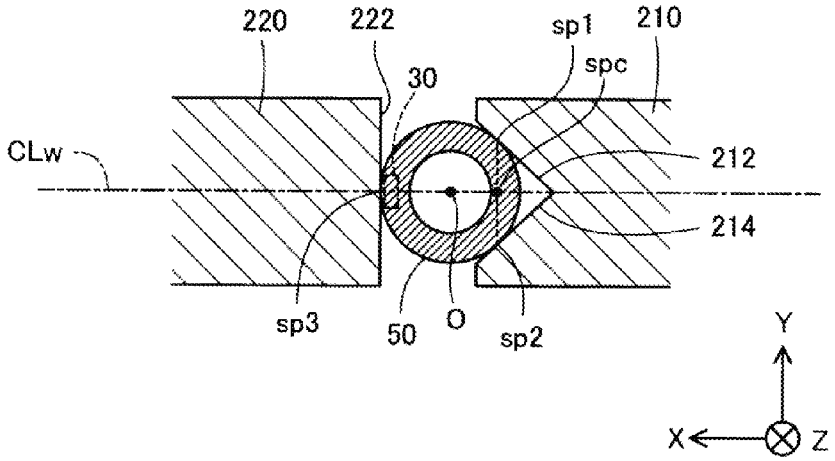
FIG. 16 is a sectional view showing the disposition of the ground electrode 30 in the vicinity of a support point sp3 on a support surface 222 of a chuck 220.

D1. Disposition in the Vicinity of Support Point:

FIG. 16 is a sectional view showing the disposition of the ground electrode 30 in the vicinity of the support point sp3 on the support surface 222 of the chuck 220. More specifically, as viewed on a horizontal plane of projection, the ground electrode 30 is positioned on a line segment which connects the axial line O of the metallic shell 50 and the support point sp3 on the support surface 222 of the chuck 220.

Through employment of such a mode, there can be reduced the distance between a portion to be resistance-welded (in FIG. 16, the ground electrode 30) and the support point sp3 at which the chucks support the metallic shell 50. As a result, a current path through which current flows and which connects the support point sp3 of the metallic shell 50 and a portion to be resistance-welded becomes unlikely to vary. Therefore, resistance welding can be performed while quality is maintained stably.

Similarly, as viewed on a horizontal plane of projection, the ground electrode 30 can be disposed at a position on a line segment which connects the axial line O of the metallic shell 50 and the support point sp1 or sp2 of the chuck 210. The expression "the ground electrode is disposed at a position on a line segment" means that, as viewed on a horizontal plane of projection, a portion of the ground electrode is positioned on the line segment which connects the axial line of the metallic shell and a support point.

Figure 17:
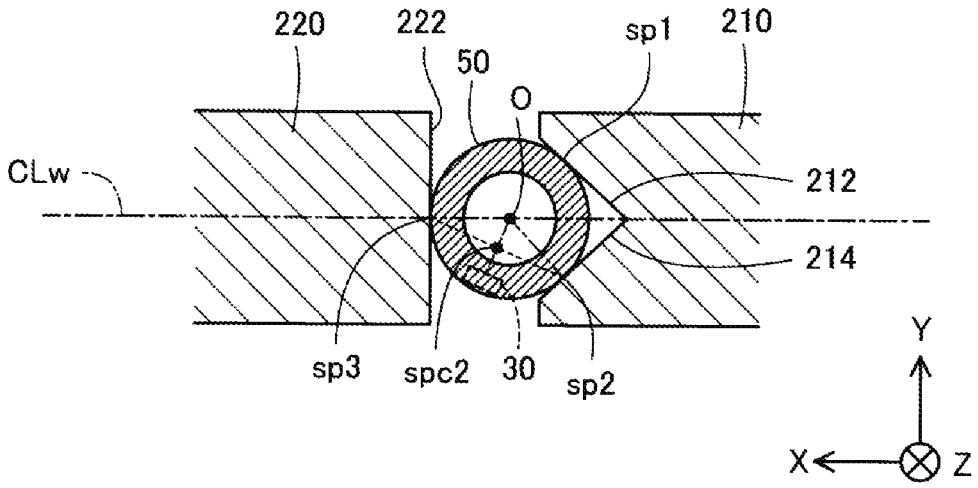
FIG. 17 is a sectional view showing a mode in which the ground electrode 30 is disposed in the vicinity of a midpoint between the support point sp3 on the support surface 222 of the chuck 220 and a support point sp2 on a second surface 214 of a chuck 210.

D2. Disposition in the Vicinity of Midpoint between Two Support Points:

FIG. 17 is a sectional view showing a mode in which the ground electrode 30 is disposed in the vicinity of a midpoint between the support point sp3 on the support surface 222 of the chuck 220 and the support point sp2 on the second surface 214 of the chuck 210. More specifically, as viewed on a horizontal plane of projection, the ground electrode 30 is disposed at a position which is located on a straight line passing through the axial line O of the metallic shell 50 and through a midpoint spc2 between the support point sp3 on the support surface 222 of the chuck 220 and the support point sp2 on the second surface 214 of the chuck 210 and which is located on the same side as the support points sp2 and sp3 with respect to the axial line O.

Through employment of such a mode, the distance between a portion to be resistance-welded (in FIG. 17, the ground electrode 30) and the support point sp2 at which the metallic shell is supported by the chuck, and the distance between the portion to be resistance-welded and the support point sp3 can be equal to each other. When, due to manufacturing errors or the like, a region where the ground electrode 30 and the metallic shell 50 are in contact with and welded to each other approaches one of the two support points sp2 and sp3, the region is distanced from the other support point, and vice versa. As a result, variation in the total length of current paths stemming from manufacturing errors becomes small, whereby resistance welding can be performed stably.

Similarly, as viewed on a horizontal plane of projection, the ground electrode 30 can be disposed at a position which is located on a straight line passing through the axial line O of the metallic shell 50 and through a midpoint between the support point sp3 on the support surface 222 of the chuck 220 and the support point sp1 on the first surface 212 of the chuck 210 and which is located on the same side as the support points sp1 and sp3 with respect to the axial line O. Also, as viewed on a horizontal plane of projection, the ground electrode 30 can be disposed at a position which is located on a straight line passing through the axial line O of the metallic shell 50 and through a midpoint between the support point sp1 and the support point sp2 of the chuck 210 and which is located on the same side as the support points sp1 and sp2 with respect to the axial line O. The expression "the ground electrode is disposed at a position on a straight line" means that, as viewed on a horizontal plane of projection, a portion of the ground electrode is positioned on the straight line which connects the axial line of the metallic shell and a support point.

E. Modifications:

E1. Modification 1:

In the above embodiment, the first surface 212 and the second surface 214 of the chuck 210 face each other while forming an angle of 90 degrees. However, the inner surface which defines the recess of a chuck having a larger number of support points than the other chuck may be modified as follows. For example, the inner surface of the recess may have two planes which face each other while forming an angle of less than 90 degrees, such as 45 degrees. Also, the inner surface of the recess may have two planes which face each other while forming an angle of greater than 90 degrees, such as 120 degrees. Further, the inner surface of the recess may partially have a curved surface (see FIG. 11).

E2. Modification 2:

In the above embodiment and modes, the outline of a horizontal section of a chuck has a straight line or a convexly curved line which contains a point at which the chuck supports the metallic shell. However, the horizontal section of a chuck may have other outlines. For example, the outline of a horizontal section of a chuck may include two straight lines which define an apex at which the chuck supports the metallic shell.

E3. Modification 3:

In the above embodiment, the chuck 210 supports the metallic shell at two points, whereas the chuck 220 supports the metallic shell at one point. The number of points at which each chuck supports the metallic shell to be subjected to welding may be modified to other number, such as one, three, or more. However, preferably, the number of support points of one chuck is smaller than the number of support points of the other chuck. Herein, the term "support point (contact point)" means a support point (contact point) at which a member is supported through point contact in the case where the member is manufactured to a theoretical shape as designed and is not elastically deformed at all. Therefore, the concept of "support point (contact point)" encompasses a support portion (contact portion) at which a member is supported through surface contact at a predetermined area as a result of elastic deformation of the member stemming from manufacturing errors of the member.

E4. Modification 4:

In the above embodiment, the chucks are composed of two chucks, namely the chuck 210 and the chuck 220. However, the chucks of the welding apparatus will suffice so long as the chucks include mutually facing chucks, and may include chucks other than the mutually facing chucks. As a result, the welding apparatus may have more than two chucks. Herein, "mutually facing chucks" include chucks whose center axes are deviated from each other, such as a combination of the chucks 220*e* and 210*e*1 and a combination of the chucks 220*e* and 210*e*2 in FIG. 12.

E5. Modification 5:

In the above embodiment, inert gas is emitted toward a weld region from a lower position. However, inert gas may be emitted toward the weld region from a horizontal direction or from an upper position. However, in a mode in which one object of welding is to be joined to the other object of welding from above, preferably, inert gas is emitted toward the weld region from a horizontal direction or from a lower position. Through employment of such a mode of emission, while interference with a holder for an upper object of welding is avoided, inert gas can be supplied to the weld region from near the weld region. As a result, as compared with a mode in which, in order to avoid interference with the holder, inert gas is supplied to the weld region from a position rather distant from the weld region, inert gas can be efficiently supplied to the weld region.

E6. Modification 6:

In the above embodiment, the annular end surface 51 of the metallic shell 50 having an annular section has a radial width of 1.5 mm. However, in a member having an annular section, the annular end surface of the member to which the ground electrode is to be joined may have a radial width of less than 1.5 mm, such as 1 mm, or a radial width of greater than 1.5 mm, such as 2 mm. However, in a mode in which the annular end surface of the member having an annular section to which the ground electrode is to be joined has a radial width of 1.5 mm or less, in the event of deviation of a relative angle between the objects of welding from an intended value, welding strength is highly likely to deteriorate. Thus, the present invention is particularly effective for such a mode.

In the above embodiment, the dimension L1 along the axial line O-O from the end surface 51 of the metallic shell 50 to an end surface of the trunk portion 54 is 26.5 mm. However, the dimension L1 may be less than 26.5 mm, such as 25 mm, or greater than 26. 5 mm, such as 30 mm. However, in a mode in which the dimension L1 is 26.5 mm or more, positional and angular errors of disposition of objects of welding before welding have a great effect on accuracy in relative position between the objects of welding in welding. Thus, the present invention is particularly effective for such a mode.

In the above embodiment, the mounting threaded portion 52 employs a nominal size of, for example, M8, M10, or M12 . However, the mounting threaded portion 52 may have other nominal sizes, such as M14 and M18. However, in a mode in which the nominal size is M12 or less, since the dimension L1 becomes small, positional errors of disposition of objects of welding before welding have a great effect on accuracy in relative position between the objects of welding in welding. Thus, the present invention is particularly effective for such a mode. Notably, the nominal size beginning with "M" is in a dimensional unit of mm.

The present invention is not limited to the above-described embodiment and modifications, but may be embodied in various other forms without departing from the spirit of the invention. For example, in order to solve, partially or entirely, the above-mentioned problem or yield, partially or entirely, the above-mentioned effects, technical features of the embodiments and modifications corresponding to technical features of the modes described in the section "Summary of the Invention" can be replaced or combined as appropriate. Also, the technical feature(s) may be eliminated as appropriate unless the present specification mentions that the technical feature(s) is mandatory.

DESCRIPTION OF REFERENCE NUMERALS

10: center electrode
12: electrode base metal
14: core metal
16: seal member
17: ceramic resistor
18: seal member
19: metal terminal member
20: insulator
22: leg portion
24: first trunk portion
25: collar portion
26: second trunk portion
28: axial hole
30: ground electrode
40: gasket
50: metallic shell
50*h*: hole
51: end surface
52: mounting threaded portion
54: trunk portion
55: groove portion
56: tool engagement portion
58: crimp portion
62: packing
63: filler member
100: spark plug
200: welding apparatus
210, 210*a*, 210*b*, 210*d*, 210*f*, 210*p*, 210*q*: chuck
210*e*1: chuck
210*e*2: chuck
210*q*1, 210*q*2: portion of chuck 210*q* which relatively protrude
210*q*3: portion of chuck 210*q* which is recessed
211, 211*a* to 211*d*: recess
211*e*: gap
212, 212*a*, 212*b*: first surface
214, 214*a*, 214*b*: second surface
215: support member
216*a*: third surface
218*d*, 218*e*: protrusion
218*f*: plane
219*d*, 219*e*: protrusion
220, 220*c* to 220*e*, 220*q*: chuck
220*q*1 to 220*q*3: portion of chuck 220*q* which relatively protrude
220*q*4, 220*q*5: portion of chuck 220*q* which is relatively recessed
222: support surface
222*d*, 222*e*: protrusion
225: support member
227: protrusion
240: gas nozzle
250: holder
300: engine head
310: mounting threaded hole
O-O, O: axial line
Ai: arrow indicative of inert gas
spc: midpoint between support point sp1 and support point sp2
spc2: midpoint between support point sp2 and support point sp3
L1: dimension along axial line O-O from end surface 51 to end surface of trunk portion 54
Ap: arrow indicative of direction of pressing ground electrode 30
As: arrow indicative of sliding direction of support member 215 and chuck 210
sp1, sp2, sp3: support point
CLw: straight line indicative of centerline of chuck Having described the invention, the following is claimed:

1. A method of manufacturing a spark plug, comprising:

chucking a metallic shell extending along its center axis between mutually facing chucks so as to fix the metallic shell therebetween;

pressing a ground electrode against the chucked metallic shell; and during the pressing, resistance-welding the ground electrode and the chucked metallic shell by applying voltage between the ground electrode and the chucked metallic shell, wherein mutually facing sides of the mutually facing chucks differ in shape from each other, wherein the mutually facing chucks include a first chuck and a second chuck that faces the first chuck, and wherein, as viewed on an imaginary plane of projection perpendicular to the center axis, an amount of support points on the second chuck for supporting the metallic shell is less than an amount of support points on the first chuck for supporting the metallic shell.

2. The method of manufacturing a spark plug according to claim 1, wherein, as viewed on the imaginary plane, the amount of the support points on the first chuck is two or more and the amount of the support points on the second chuck is one or more, and wherein, as viewed on the imaginary plane, the chucked metallic shell is supported at two of the support points on the first chuck and one of the support points on the second chuck.

3. The method of manufacturing a spark plug according to claim 2, wherein, as viewed on the imaginary plane, the second chuck has a support surface that supports the chucked metallic shell, and wherein at least a portion of the support surface of the second chuck is positioned on a straight line that connects the center axis of the metallic shell and a midpoint between the two of the support points on the first chuck supporting the chucked metallic shell.

4. The method of manufacturing a spark plug according to claim 3, wherein, as viewed on the imaginary plane, the first chuck has first and second surfaces that support the chucked metallic shell and partially constitute a surface of a recess of the first chuck, the recess being configured to receive the metallic shell for the chucking thereof, wherein, as viewed on the imaginary plane, the first surface and the second surface of the first chuck are symmetrical to each other with respect to the straight line that connects the center axis of the metallic shell and the midpoint between the two of the support points on the first chuck supporting the chucked metallic shell, and wherein, as viewed on the imaginary plane, the support surface of the second chuck is symmetrical with respect to the straight line.

5. The method of manufacturing a spark plug according to claim 4, wherein the first and the second surfaces are planes.

6. The method of manufacturing a spark plug according to claim 1, wherein the chucking includes pressing the metallic shell against the second chuck by the first chuck so as to fix the metallic shell therebetween, the second chuck being positionally fixed.

7. The method of manufacturing a spark plug according to claim 1, wherein the pressing of the ground electrode includes pressing the ground electrode against a position located on the chucked metallic shell and a line segment that connects the center axis of the chucked metallic shell and any one of the support points at which the first and the second chucks support the chucked metallic shell as viewed on the imaginary plane.

8. The method of manufacturing a spark plug according to claim 2, wherein, as viewed on the imaginary plane, the pressing of the ground electrode includes pressing the ground electrode against a position located on the chucked metallic shell and in a direction directed from the center axis of the chucked metallic shell toward a midpoint between two of the three support points at which the first and the second chucks support the chucked metallic shell.

9. The method of manufacturing a spark plug according to claim 2, wherein the metallic shell has a portion having a substantially circular columnar shape, wherein the first and second chucks have respective lengths greater than or equal to a length of the substantially circular columnar shape portion of the metallic shell along the center axis of the metallic shell, and the chucked metallic shell is supported along the center axis thereof by the first chuck at the two support points over an entire length of the substantially circular columnar shape portion and the second chuck at the one support point over the entire length of the substantially circular columnar shape portion.

10. The method of manufacturing a spark plug according to claim 1, wherein the pressing the ground electrode includes disposing the ground electrode above the chucked metallic shell, and wherein the resistance-welding is performed while supplying an inert gas toward a contact region between the ground electrode and the chucked metallic shell from a horizontal direction or from a lower position.

11. The method of manufacturing a spark plug according to claim 1, wherein a surface of the metallic shell to which the ground electrode is connected has a width of 1.5 mm or less in a radial direction of the metallic shell.

12. The method of manufacturing a spark plug according to claim 1, wherein the metallic shell comprises a first portion which has a substantially circular columnar shape having a first diameter and an end to which the ground electrode is resistance-welded, and a second portion which has a substantially circular columnar shape having a second diameter greater than the first diameter, wherein the chucked metallic shell is chucked at the first portion by the first and the second chucks, and wherein, in the metallic shell, a distance from an end surface of the second portion located toward the first portion to the end of the first portion to which the ground electrode is resistance-welded is 26.5 mm or greater.

13. The method of manufacturing a spark plug according to claim 1, wherein, during the resistance-welding of the ground electrode and the chucked metallic shell, the mutually facing chucks are applied as an electrode.

14. The method of manufacturing a spark plug according to claim 1, wherein the metallic shell has a tubular shape.

15. The method of manufacturing a spark plug according to claim 1, wherein the metallic shell includes a protruding portion that protrudes outward in a radial direction of the metallic shell from a surface of the metallic shell to which the ground electrode is resistance-welded, and wherein the chucks chuck the protruding portion.

16. The method of manufacturing a spark plug according to claim 1, wherein the ground electrode is resistance-welded to a part of a welding surface of the metallic shell.

* * * * *